US012716140B2

(12) United States Patent
Mues et al.

(10) Patent No.: US 12,716,140 B2
(45) Date of Patent: Aug. 25, 2026

(54) SEPARATOR FOR WATER ELECTROLYSIS

(71) Applicant: AGFA-Gevaert NV, Mortsel (BE)

(72) Inventors: Willem Mues, Mortsel (BE); Cristina Tudisco, Mortsel (BE); Hanne Verwaest, Mortsel (BE)

(73) Assignee: AGFA-Gevaert NV, Mortsel (BE)

( * ) Notice: Subject to any disclaimer, the term of this patent is extended or adjusted under 35 U.S.C. 154(b) by 593 days.

(21) Appl. No.: 18/013,592

(22) PCT Filed: Jun. 30, 2021

(86) PCT No.: PCT/EP2021/067951
§ 371 (c)(1),
(2) Date: Dec. 29, 2022

(87) PCT Pub. No.: WO2022/002999
PCT Pub. Date: Jan. 6, 2022

(65) Prior Publication Data

US 2023/0332310 A1 Oct. 19, 2023

(30) Foreign Application Priority Data

Jul. 3, 2020 (EP) ..... 20183861

(51) Int. Cl.

| | |
|---|---|
| ***C25B 9/00*** | (2021.01) |
| ***C25B 1/04*** | (2021.01) |
| ***C25B 9/19*** | (2021.01) |
| ***C25B 13/02*** | (2006.01) |
| ***C25B 13/07*** | (2021.01) |
| ***C25B 13/08*** | (2006.01) |

(52) U.S. Cl.
CPC ..... *C25B 13/02* (2013.01); *C25B 1/04* (2013.01); *C25B 9/19* (2021.01); *C25B 13/07* (2021.01); *C25B 13/08* (2013.01)

(58) Field of Classification Search
CPC .. C25B 13/02; C25B 9/73; C25B 1/04; C25B 13/08
See application file for complete search history.

(56) References Cited

U.S. PATENT DOCUMENTS

| | | | |
|---|---|---|---|
| 4,539,084 | A | 9/1985 | Bissot et al. |
| 2020/0181785 | A1 | 6/2020 | Mues |

FOREIGN PATENT DOCUMENTS

| | | | |
|---|---|---|---|
| CN | 110869538 | A | 3/2020 |
| EP | 0122049 | A2 | 10/1984 |
| EP | 0232923 | B1 | 7/1992 |
| EP | 1776490 | B1 | 3/2016 |
| EP | 3575442 | B1 | 1/2021 |
| JP | S59-174627 | A | 10/1984 |

(Continued)

OTHER PUBLICATIONS

U.S. Appl. No. 18/013,597, filed Dec. 29, 2022.

(Continued)

*Primary Examiner* — Zulmariam Mendez
(74) *Attorney, Agent, or Firm* — Leydig, Voit & Mayer, Ltd.

(57) ABSTRACT

A separator for alkaline electrolysis comprising a support (10) and a porous layer (20) provided on the support, characterized in that the support is capable of being substantially removed from the separator. The support is preferably removed by the electrolyte of an alkaline electrolyser.

20 Claims, 5 Drawing Sheets

(56) References Cited

FOREIGN PATENT DOCUMENTS

| | | | | |
|---|---|---|---|---|
| JP | 2014-129563 | A | | 7/2014 |
| JP | 2020-012121 | A | | 1/2020 |
| KR | 10-2020-0018588 | A | | 2/2020 |
| WO | WO 2009/147084 | A1 | | 12/2009 |
| WO | WO 2009/147086 | A1 | | 12/2009 |
| WO | WO2015/140356 | | * | 9/2015 |
| WO | WO 2019/011844 | A1 | | 1/2019 |

OTHER PUBLICATIONS

European Patent Office, International Search Report in International Patent Application No. PCT/EP2021/067951, mailed Sep. 27, 2021, 3 pp.

European Patent Office, Written Opinion in International Patent Application No. PCT/EP2021/067951, mailed Sep. 27, 2021, 5 pp.

* cited by examiner

SEPARATOR FOR WATER ELECTROLYSIS

CROSS-REFERENCE TO RELATED APPLICATIONS

This patent application is the U.S. national stage of copending International Patent Application No. PCT/EP2021/067951, filed Jun. 30, 2021, which claims the benefit of European Patent Application No. 20183861.2, filed Jul. 3, 2020.

TECHNICAL FIELD OF THE INVENTION

The present invention relates to a method of manufacturing a separator for water electrolysis and to separators obtained with the method.

BACKGROUND ART FOR THE INVENTION

Nowadays, hydrogen is used in several industrial processes, for example its use as raw material in the chemical industry and as a reducing agent in the metallurgic industry. Hydrogen is a fundamental building block for the manufacture of ammonia, and hence fertilizers, and of methanol, used in the manufacture of many polymers. Refineries, where hydrogen is used for the processing of intermediate oil products, are another area of use.

Hydrogen is also being considered an important future energy carrier, which means it can store and deliver energy in a usable form. Energy is released by an exothermic combustion reaction with oxygen thereby forming water. During such combustion reaction, no greenhouse gases containing carbon are emitted.

For the realization of a low-carbon society, renewable energies using natural energy such as solar light and wind power are becoming more and more important.

The production of electricity from wind power and solar power generation systems is very much dependent on the weather conditions and therefore variable, leading to an imbalance of demand and supply of electricity. To store surplus electricity, the so-called power-to-gas technology wherein electrical power is used to produce gaseous fuel such as hydrogen, attracted much interest in recent years. As production of electricity from renewable energy sources will increase, the demand for storage and transportation of the produced energy will also increase.

Alkaline water electrolysis is an important manufacturing process wherein electricity may be converted into hydrogen.

In an alkaline water electrolysis cell, a so-called separator or diaphragm is used to separate the electrodes of different polarity to prevent a short circuit between these electronic conducting parts (electrodes) and to prevent the recombination of hydrogen (formed at the cathode) and oxygen (formed at the anode) by avoiding gas crossover. While serving in all these functions, the separator should also be a highly ionic conductor for transportation of hydroxyl ions from the cathode to the anode.

A separator typically includes a porous support. Such a porous support reinforces the separator facilitating the manipulation of the separator and the introduction of the separator in an electrolyser as disclosed in EP-A 232 923 (Hydrogen Systems).

A preferred porous support is prepared from polypropylene (PP) or polyphenylene sulphide (PPS) due to their high resistance to high-temperature, high concentration alkaline solutions.

EP-A 1776490 (VITO) discloses a process of preparing a reinforced separator. The process leads to a membrane with symmetrical characteristics. The process includes the steps of providing a porous support as a web and a suitable dope solution, guiding the web in a vertical position, equally coating both sides of the web with the dope solution to produce a web coated support, and applying a symmetrical surface pore formation step and a symmetrical coagulation step to the dope coated web to produce a reinforced membrane.

WO2009/147084 and WO2009/147086 (Agfa Gevaert and VITO) disclose manufacturing methods to produce a reinforced membrane with symmetrical characteristics as described in EP-A 1776490.

However, a porous support may decrease the ionic conductivity through the separator and therefore the efficiency of the electrolytic process.

There is thus a need for separators having sufficient mechanical qualities combined with a high ionic conductivity.

SUMMARY OF THE INVENTION

It is an object of the invention to provide a separator having sufficient mechanical qualities and an improved ion conductivity.

This object is realized with the separator as defined in claim 1.

It is another object of the invention to provide a method of preparing such a separator.

Further objects of the invention will become apparent from the description hereinafter.

DETAILED DESCRIPTION OF THE INVENTION

Separator for Water Electrolysis

Figure 1:
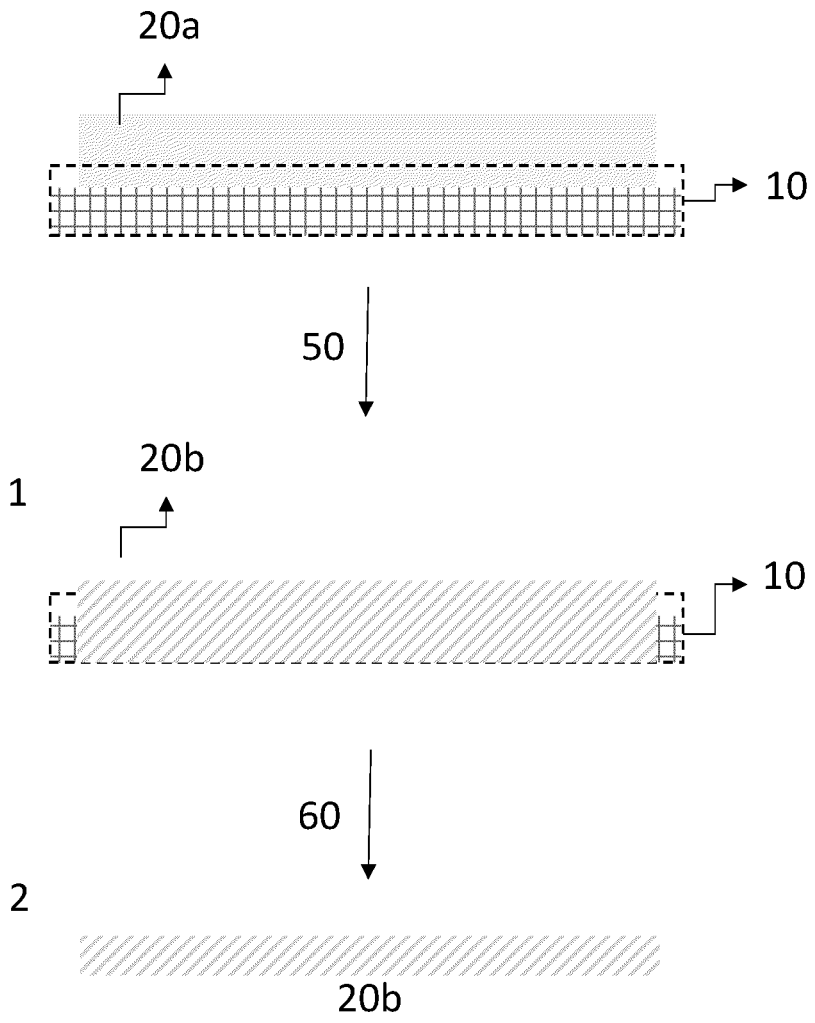
FIG. 1 shows schematically an embodiment of a separator according to the present invention.

The separator for water electrolysis, preferably alkaline water electrolysis, according to the present invention comprises a porous support (10) and a porous layer (20), characterized in that the porous support is capable of being substantially removed from the separator.

The porous support is preferably removed by an alkaline solution, more preferably by an electrolyte of an alkaline electrolyser.

The alkaline solution or the electrolyte of an alkaline electrolyser is preferably a 10 to 40 wt %, more preferably a 20 to 35 wt %, aqueous KOH solution. A particular preferred alkaline solution or electrolyte is a 30 wt % aqueous KOH solution.

The temperature of the alkaline solution or electrolyte is preferably 50° C. or more, more preferably 80° C. or more.

The removal of the porous support is preferably the result of dissolution of the support in or degradation of the support by an alkaline solution or the electrolyte used in the electrolyser.

The porous support is a temporary support. The temporary support is used to give support and strength to the separator in its manufacturing process, i.e. the coating step and/or coagulation step described below. The reinforcement of the separator by the temporary support in the manufacturing process also facilitates washing, rewinding, etc. of the separator.

The temporary support also gives strength and tear resistance to the separator in a converting process, wherein for example the separator is cut into different formats, and in an assembly process, wherein the separator is introduced between the electrodes of an alkaline electrolyser.

The temporary support is substantially removed by an electrolyte of an alkaline electrolyser.

Once placed in an electrolytic cell of an alkaline electrolyser, the reinforcement of the separator by the porous support is no longer necessary. Especially is a so-called zero gap configuration, described below, the separator does not vibrate due to escaping gas bubbles and therefore does not suffer from fatigue that could lead to cracks or tearing in the separator. Therefore, the separator according to the present invention is preferably used in such a zero-gap configuration membrane electrode assembly.

A mentioned above, the presence of a porous support to reinforce the separator may adversely affect the ionic conductivity through the separator. Preferably, after removal of the temporary support, the ionic conductivity of the separator increases.

Dissolved material from the support or degradation products of the support after removal of the support by the electrolyte of an alkaline electrolyser preferably does not adversely affect the electro-catalytic properties of the electrodes, or the electrolytic process.

The support is preferably at least 50 wt %, more preferably at least 75 wt %, most preferably at least 90 wt %, particular preferred at least 95 wt % removed by an alkaline solution or an electrolyte of an alkaline electrolyser. In a most preferred embodiment, the support is completely removed by the electrolyte of an alkaline electrolyser.

Preferably, the support is substantially removed after residing 24 to 48 hours in an alkaline solution or an electrolyte of an alkaline electrolyser. However, the support may also be substantially removed after 2 weeks or a month in the alkaline solution or the electrolyte of an alkaline electrolyser.

However, the temporary support has to withstand the ingredients, in particular the solvents, used in a preparation method of the separator.

For example, the temporary support has to be resistant against the solvents of a dope solution used in a preparation method of the separator described below preferably for at least 0.5 minute, more preferably for at least 1 minute, most preferably for at least 2 minutes, particularly preferred for at least 5 minutes to enable a coating step wherein a dope solution is applied on the temporary support.

After a coagulation step described below, the solvents of a dope solution are removed, resulting in a very low residual amount (preferably <10 g/m$^2$, more preferable <5 g/m$^2$) that will no longer affect the support.

A described below in more detail a preferred separator is prepared by the application on one or both surfaces of a porous support of a coating solution, typically referred to as a dope solution, comprising a polymer resin, hydrophilic inorganic particles and a solvent. A porous layer is then obtained after a phase inversion step wherein the polymer resin forms a three-dimensional porous polymer network.

Upon application of the dope solution on a surface of the porous support, the dope solution impregnates the support. The porous support is preferably completely or partially by more than 50 wt % impregnated with the dope solution.

When two dope solutions are applied on both surfaces of the porous support, both dope solutions impregnate the support. Also in this embodiment a completely or partially by more than 50% impregnated support is preferred.

After phase inversion, the impregnation of the support ensures that the three-dimensional porous polymer network also extends into the support. This results in a good adhesion between the porous hydrophilic layer and the support.

A preferred separator (1) is schematically shown in FIG. 1.

A dope solution 20*a* has been applied on one side of a porous support (10) and the support is preferably fully impregnated with the applied dope solution. After a phase inversion step (50), a separator (1) is obtained comprising a support (10) and a porous layer (20*b*).

The porous support may optionally be removed before assembly in an electrolyser stack by treatment of the separator (1) with an alkaline solution (60) resulting in the separator (2).

Figure 2:
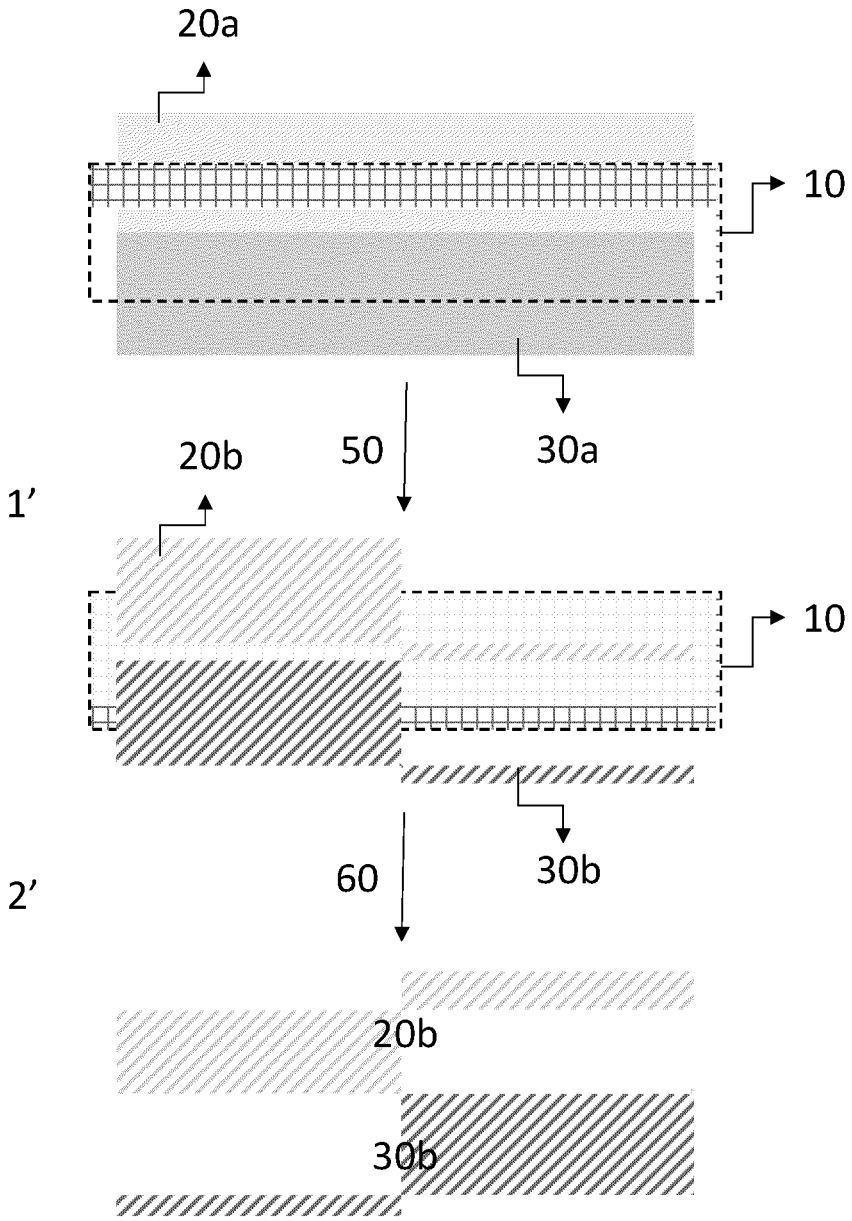
FIG. 2 shows schematically another embodiment of a separator according to the present invention.

Another preferred separator (1') is schematically shown in FIG. 2.

A dope solution has been applied on both sides of a porous support (10) and the support is preferably fully impregnated with the applied dope solution. The applied dope layers are referred to as 20*a* and 30*a*.

After a phase inversion step (50), a separator (1') is obtained comprising a support (10) and on either side of the porous support a porous layer (20*b*, 30*b*).

The porous support may be optionally be removed by treatment of the separator (1') with an alkaline solution (60) resulting in the separator (2').

The pore diameter of the separator has to be sufficiently small to prevent recombination of hydrogen and oxygen by avoiding gas crossover. On the other hand, to ensure efficient transportation of hydroxyl ions from the cathode to the anode, larger pore diameters are preferred. An efficient transportation of the hydroxyl ions requires an efficient penetration of electrolyte into the separator.

The maximum pore diameter (PDmax) of the separator is preferably between 0.05 and 2 μm, more preferably between 0.10 and 1 μm, most preferably between 0.15 and 0.5 μm.

Both sides of the separator may have identical or different maximum pore diameters.

A preferred separator of which both sides have identical pore diameters is disclosed in EP-A 1776480 and WO2009/147084 mentioned above.

A preferred separator of which both sides have different pore diameters is disclosed in EP-A 3652362. The maximum pore diameter at the outer surface of a first porous layer PDmax(1) is preferably between 0.05 and 0.3 μm, more preferably between 0.08 and 0.25 μm, most preferably between 0.1 and 0.2 μm and the maximum pore diameter at the outer surface of a second porous layer PDmax(2) is preferably between 0.2 and 6.5 μm, more preferably between 0.2 and 1.50 μm, most preferably between 0.2 and 0.5 μm.

The ratio between PDmax(2) and PDmax(1) is preferably between 1.1 to 20, more preferably between 1.25 and 10, most preferably between 2 and 7.5.

The smaller PDmax(1) ensure an efficient separation of hydrogen and oxygen while PDmax(2) ensures a good penetration of the electrolyte in the separator resulting in a sufficient ionic conductivity.

The pore diameter referred to is preferably measured using the Bubble Point Test method described in American Society for Testing and Materials Standard (ASMT) Method F316.

The porosity of the separator is preferably between 30 and 70%, more preferably between 40 and 60%. A separator having a porosity within the above ranges typically has excellent ion permeability and excellent gas barrier properties because the pores of the diaphragm are continuously filled with an electrolyte solution.

The thickness of the separator is preferably between 50 and 500 μm, more preferably between 75 and 250 μm, most preferably between 100 and 200 nm.

Porous Support

The thickness of the support is preferably from 20 μm up to 400 μm, more preferably from 40 μm up to 200 μm, most preferably from 60 μm up to 100 μm.

As the temporary support is removed in the electrolyser, it does not has to be resistant to the highly alkaline electrolyte solutions.

The support is preferably a continuous web to enable a manufacturing process as disclosed in EP-A 1776490 and WO2009/147084.

The web preferably has a width from 30 to 300 cm, more preferably from 40 to 200 cm.

The temporary support is preferably a porous polymer fabric. The porous polymer fabric may be woven or non-woven.

In order to design fabrics that may be removed from the separator upon alkaline treatment the following approaches are preferred:

- introducing alkaline solubilizing groups on the main polymer of the fabric fibers;
- introducing alkaline reactive groups on the main polymer of the fabric fibers; and
- introducing alkaline degradable functional groups in the backbone of the main polymer of the fabric fibers.

Preferred alkaline solubilizing groups are functional groups having a pKa of 10 and lower, more preferably of 8 and lower and most preferably of 6 and lower.

Particularly preferred alkaline solubilizing groups are selected from the group consisting of phenols, sulfonamides, carboxylic acids, phosphonic acids, phosphoric acid esters and sulfonic acids, carboxylic acids being particularly preferred.

Preferred alkaline reactive groups are selected from the group consisting of esters and anhydrides, esters being particularly preferred.

Preferred alkaline degradable groups are esters.

The fabric fibers can be selected from natural polymers, synthetic polymers or combinations thereof. The fabrics are preferably selected from the group consisting of cotton fabrics, silk fabrics, flax fabrics, jute fabrics, hemp fabrics, modal fabrics, bamboo fabrics, pineapple fabrics, basalt fabrics, ramie fabrics, polyester based fabrics, acrylic based fabrics, glass fibre fabrics, aramid fibre fabrics, polyamide fabrics, polyolefine fabrics, polyurethane fabrics and mixtures thereof.

Several strategies have been disclosed to design alkali soluble fabrics.

Making cotton alkaline soluble via post modification is a long known strategy used to design alkaline soluble cellulose based fabrics as disclosed in American Dyestuff Reporter, 50(19), 67-74 (1961) and in U.S. Pat. No. 3,087,775 (US Department of Agriculture). Low functionalized carboxymethyl cellulose type of polymers are particularly preferred.

Polyamides can be functionalized in the backbone with alkaline degradable functional groups such as specific esters as disclosed in U.S. Pat. No. 5,457,144 (Rohm and Haas Company), to design alkaline soluble polyamides.

Polyolefines can be functionalized or copolymerized with monomers comprising alkaline reactive groups or alkaline solubilizing groups, preferably selected from the group consisting of an anhydride and a carboxylic acid. Copolymer of ethylene and acrylic or methacrylic acid and polyethylene, graft functionalized with maleic anhydride are particularly preferred functionalized polyolefines.

In the most preferred embodiment, the fabric is poly (ester) based as this has an intrinsic alkaline degradability. Particularly preferred poly(esters) are selected from the group consisting of poly(ethylene terephthalate), polybutylene terephthalate, polytrimethylene terephthalate, poly(lactic acid), poly(caprolactone) and copolymers thereof. Poly (lactic acid) is in particular preferred for its biodegradability and its manufacture from renewable resources.

Strategies to design poly(esters) with enhanced alkaline solubility and degradability have been disclosed based on the introduction of hydrophilic blocks, preferably poly(ethylene glycol) fragments, in the poly(ester) structure as disclosed in JP7145509 (Toyo Boseki), optionally in combination with the introduction of additional water solubilizing groups as disclosed in CN1439751 (Jinan Zhenghao Advanced Fiber Co.) and KR2018110827 (Toray Chemical Korea Inc.). Further strategies can be based on the introduction of reactive esters in the poly(ester) backbone, such as oxalate esters, making the fiber more sensitive towards alkaline treatment.

Another preferred porous support are the so-called Thermotropic Liquid Crystal Polymer (TLCP)—polyarylate meshes available from NBC Meshtec. It has been observed that for example TLCP—0053/47 PW is dissolved in a 30% KOH solution at 80° C. after 1 week.

Polymer fabrics may be used alone, or a combination of two or more polymeric fabrics may be used to manufacture the support.

The porous support may also include fabrics, which do not solubilize or disintegrate in the electrolyte solution. For example a fabric may be used that contains both threads, which solubilize or disintegrate in the electrolyte solution as described above, and threads which do not solubilize or disintegrate in the electrolyte solution.

The porous support may be a fabric wherein the ratio of the threads which solubilize or disintegrate in the electrolyte solution as described above to the threads which do not solubilize or disintegrate in that solution is at least 25 wt %, preferably at least 50 wt %, more preferably at least 75 wt %.

A separator of which at least 25 wt % of the threads making up the fabric dissolve or disintegrate in the electrolyser will have a higher ionic conductivity compared to a separator of which the fabric remains intact in the electrolyser.

For example a fabric composed of threads of polyester and threads of PPS may be used.

Polymer Resin

The porous layer comprises a polymer resin.

The polymer resin forms a three dimensional porous network, the result of a phase inversion step in the preparation of the separator, as described below.

The polymer resin may be selected from a fluorine resin such as polyvinylidene fluoride (PVDF) and polytetrafluoroethylene (PTFE), an olefin resin such as polypropylene (PP), and an aromatic hydrocarbon resin such as polyethylene terephthalate (PET) and polystyrene (PS). The polymer resins may be used alone, or two or more of the polymer resins may be used in combination.

PVDF and vinylidenefluoride (VDF)-copolymers are preferred for their oxidation/reduction resistance and film-forming properties. Among these, terpolymers of VDF, hexanefluoropropylene (HFP) and chlorotrifluoroethylene (CTFE) are preferred for their excellent swelling properties, heat resistance and adhesion to electrodes.

Another preferred polymer resin is an aromatic hydrocarbon resin for their excellent heat and alkali resistance. Examples of an aromatic hydrocarbon resin include polyethylene terephthalate, polybutylene terephthalate, polybutylene naphthalate, polystyrene, polysulfone, polyethersulfone, polyphenylene sulfide, polyphenyl sulfone, polyacrylate, polyetherimide, polyimide, and polyamide-imide.

A particular preferred polymer resin is selected from the group consisting of polysulfone, polyethersulfone and polyphenylsulfone, polysulfone being the most preferred.

The molecular weight (Mw) of polysulfones, polyether sulfones and polyphenyl sulfones is preferably between 10 000 and 500 000, more preferably between 25 000 and 250 000. When the Mw is too low, the physical strength of the porous layer may become insufficient. When the Mw is too high, the viscosity of the dope solution may become too high.

Examples of polysulfones, polyether sulfones and combinations thereof are disclosed in EP-A 3085815, paragraphs [0021] to [0032].

A polymer resin may be used alone, or two or more polymer resins may be used in combination.

Inorganic Hydrophilic Particles

The hydrophilic layer also comprises hydrophilic particles.

Preferred hydrophilic particles are selected from metal oxides and metal hydroxides.

Preferred metal oxides are selected from the group consisting of zirconium oxide, titanium oxide, bismuth oxide, cerium oxide and magnesium oxide.

Preferred metal hydroxides are selected from the group consisting of zirconium hydroxide, titanium hydroxide, bismuth hydroxide, cerium hydroxide and magnesium hydroxide. A particularly preferred magnesium hydroxide is disclosed in EP-A 3660188, paragraphs [0040] to [0063].

Other preferred hydrophilic particles are barium sulfate particles.

Other hydrophilic particles that may be used are nitrides and carbides of Group IV elements of the periodic tables.

The hydrophilic particles preferably have a D50 particle size of 0.05 to 2.0 μm, more preferably of 0.1 to 1.5 μm, most preferably of 0.15 to 1.00 μm, particularly preferred of 0.2 to 0.75 μm. The D50 particle size is preferably less than or equal to 0.7 μm, preferably less than or equal to 0.55 μm, more preferably less than or equal to 0.40 μm.

The D50 particle size is also known as the median diameter or the medium value of the particle size distribution. It is the value of the particle diameter at 50% in the cumulative distribution. For example, if D50=0.1 μm, then 50% of the particles are larger than 1.0 μm, and 50% are smaller than 1.0 μm.

The D50 particle size is preferably measured using laser diffraction, for example using a Mastersizer from Malvern Panalytical.

The amount of the hydrophilic particles relative to the total dry weight of the porous layer is preferably at least 50 wt %, more preferably at least 75 wt %.

The weight ratio of hydrophilic particles to polymer resin is preferably more then 60/40, more preferably more than 70/30, most preferably more than 75/25.

Preparation of the Separator

The method for manufacturing a separator for alkaline water electrolysis comprises the steps of:

applying a dope solution as described below on a porous support described above; and subjecting the applied dope solution to phase inversion.

In another embodiment, the method of manufacturing a separator further comprises the step of removing the porous support by treatment of the separator formed after the phase inversion step with an alkaline solution.

A dope solution may be applied to one side of the support or on both sides of the support. When a dope solution is applied on both sides of the support, the dope solution applied on either side of the support may be the same or different.

A preferred method of manufacturing a reinforced separator is disclosed in EP-A 232923. A dope solution is first applied on an inert flat substrate, for example glass or PET. The support is then immersed into the dope solution. After a phase inversion step the resulting separator is removed from the inert flat substrate.

Another preferred method of manufacturing a reinforced separator is disclosed in EP-A 1776490 and WO2009/147084 for symmetric separators and PCT/EP2018/068515 (filed Sep. 7, 2018) for asymmetric separators wherein a dope solution is applied on a support by coating. These methods result in web-reinforced separators wherein the web, i.e. the porous support, is nicely embedded in the separator, without appearance of the web at a surface of the separator.

Other manufacturing methods that may be used are disclosed in EP-A 3272908.

Dope Solution

The dope solution preferably comprises a polymer resin as described above, hydrophilic particles as described above and a solvent.

The solvent of the dope solution is preferably an organic solvent wherein the polymer resin can be dissolved. Moreover, the organic solvent is preferably miscible in water.

The solvent is preferably selected from N-methyl-pyrrolidone (NMP), N-ethyl-pyrrolidone (NEP), N-butyl-pyrrolidone (NBP), N,N-dimethylformamide (DMF), formamide, dimethylsulfoxide (DMSO), N,N-dimethylacetamide (DMAC), acetonitrile, and mixtures thereof.

A highly preferred solvent, especially for health and safety reasons, is NBP.

The dope solution may further comprise other ingredients to optimize the properties of the obtained polymer layers, for example their porosity and the maximum pore diameter at their outer surface.

The dope solution preferably comprises an additive to optimize the pore size at the surface and inside of the porous layer. Such additives may be organic or inorganic compounds, or a combination thereof.

Organic compounds which may influence the pore formation in the porous layers include polyethylene glycol, polyethylene oxide, polypropylene glycol, ethylene glycol, tripropylene glycol, glycerol, polyhydric alcohols, dibutyl phthalate (DBP), diethyl phthalate (DEP), diundecyl phthalate (DUP), isononanoic acid or neo decanoic acid, polyvinylpyrrolidone, polyvinyl-alcohol, polyvinylacetate, polyethyleneimine, polyacrylic acid, methylcellulose and dextran.

Preferred organic compounds which may influence the pore formation in the porous layers are selected from polyethylene glycol, polyethylene oxide, polyvinylpyrrolidone.

A preferred polyethylene glycol has a molecular weight of from 10000 to 50000, a preferred polyethylene oxide has a molecular weight of from 50000 to 300000, and a preferred polyvinylpyrrolidone has a molecular weight of from 30000 to 1000000.

A particularly preferred organic compound which may influence the pore formation in the porous layers is glycerol.

The amount of compounds which may influence the pore formation is preferably between 0.1 and 15 wt %, more preferably between 0.5 and 5 wt % relative to the total weight of the dope solution.

Inorganic compounds which may influence the pore formation include calcium chloride, magnesium chloride, lithium chloride and bariumsulfate.

A combination of two or more additives that influence the pore formation may be used.

In case two polymers layers are applied on the porous support, the dope solution used for both layers may be identical or different from each other.

Applying the Dope Solution

The dope solution may be applied on a surface of a porous support by any coating or casting technique.

However, a dope solution may also be applied by immersing the support into the dope solution as described above and disclosed in EP-A 232923.

A preferred coating technique is for example extrusion coating.

In a highly preferred embodiment, the dope solutions are applied by a slot die coating technique. When a dope solution is applied on one side of the support, one slot coating die is typically used. When a dope solution is applied on both sides of the support, preferable two slot coating dies located on either side of the support. (FIGS. 3 and 4, 200 and 300). The slot coating dies are capable of holding the dope solution at a predetermined temperature, distributing the dope solutions uniformly over the support, and adjusting the coating thickness of the applied dope solutions.

The viscosity of the dope solutions, when used in a slot die coating technique, is preferably between 1 and 500 Pa·s, more preferably between 10 and 100 Pa·s, at coating temperature and at a shear rate of 1 $s^{-1}$.

The dope solutions are preferably shear-thinning. The ratio of the viscosity at a shear rate of 1 $s^{-1}$ to the viscosity at a shear rate of 100 $s^{-1}$ is preferably at least 2, more preferably at least 2.5, most preferably at least 5.

Figure 3:
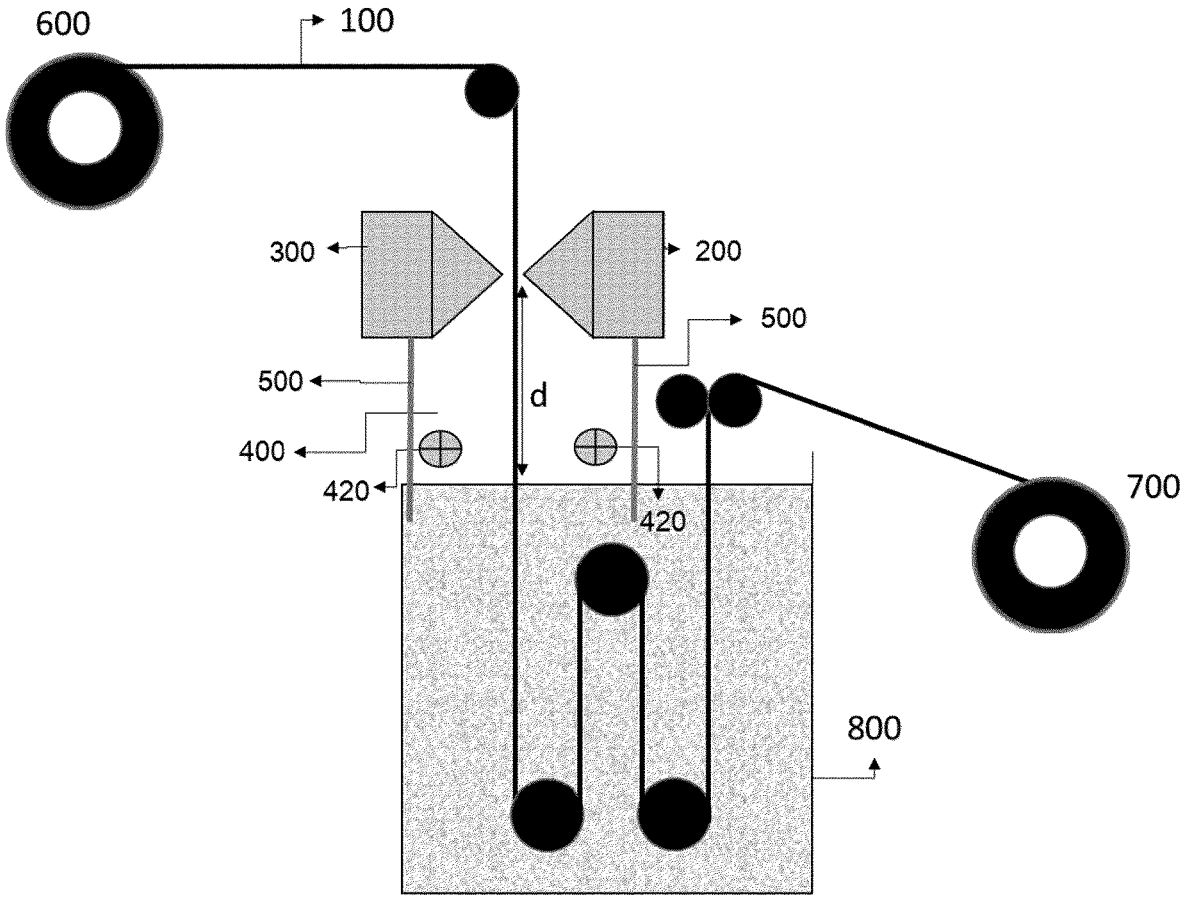
FIG. 3 shows schematically an embodiment of a preparation method of a separator according to the present invention.
Figure 4:
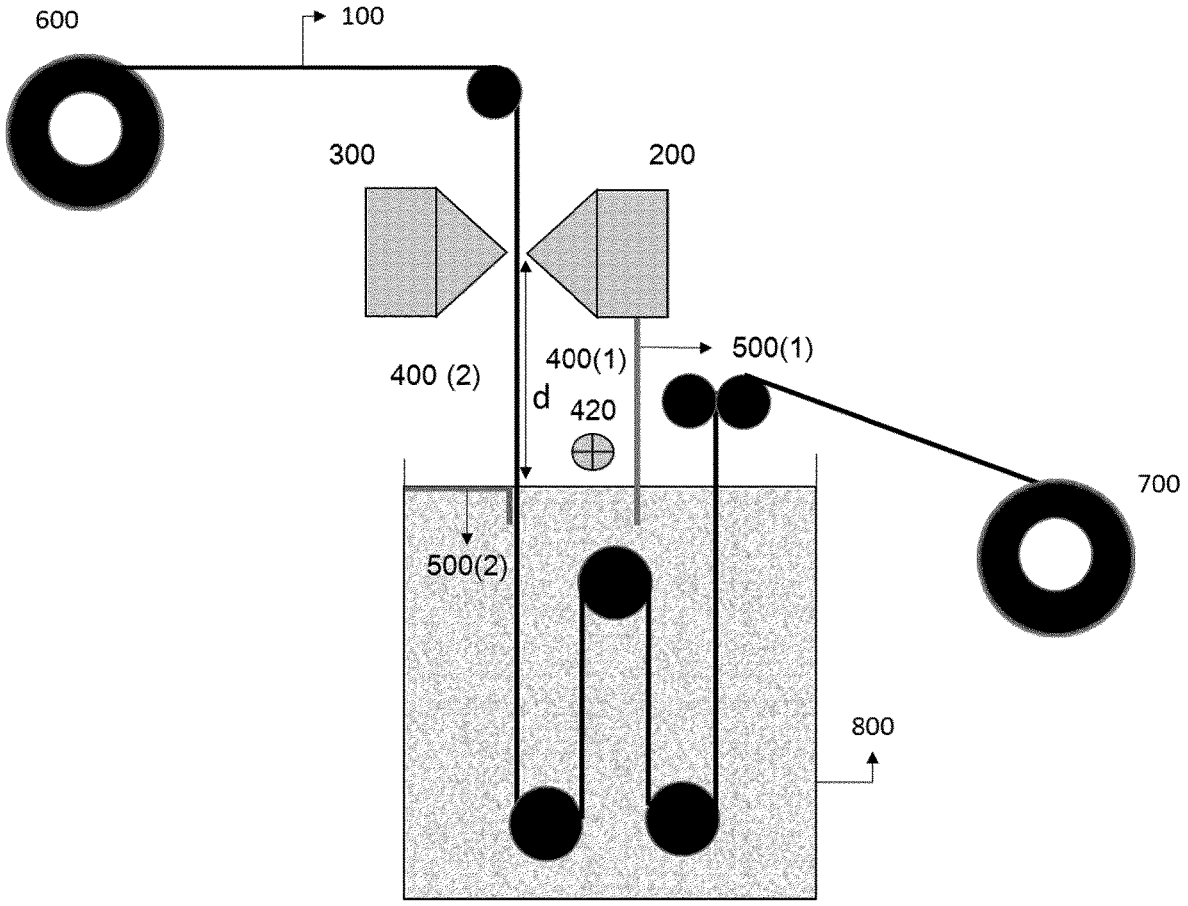
FIG. 4 shows schematically another embodiment of a preparation method of a separator according to the present invention.

The support is preferably a continuous web, which is transported downwards between the slot coating dies (200, 300) as shown in FIGS. 3 and 4.

Immediately after the application, the support preferably becomes impregnated with the dope solutions.

Preferably, the support becomes fully impregnated with the applied dope solutions.

Phase Inversion Step

After applying a dope solution onto the support, the applied dope solution is subjected to phase inversion. In the phase inversion step, the applied dope solution is transformed into a porous hydrophilic layer.

Any phase inversion mechanism may be used to prepare the porous hydrophilic layers from the applied dope solutions.

The phase inversion step preferably includes a so-called Liquid Induced Phase Separation (LIPS) step, a Vapour Induced Phase Separation (VIPS) step or a combination of a VIPS and a LIPS step. The phase inversion step preferably includes both a VIPS and a LIPS step.

Both LIPS and VIPS are non-solvent induced phase-inversion processes.

In a LIPS step the support coated with a dope solution is contacted with a non-solvent that is miscible with the solvent of the dope solution.

Typically, this is carried out by immersing the support coated with a dope solution into a non-solvent bath, also referred to as coagulation bath.

The non-solvent is preferably water, mixtures of water and an aprotic solvent selected from the group consisting of N-methylpyrrolidone (NMP), dimethylformamide (DMF), dimethylsulfoxide (DMSO) and dimethylacetamide (DMAC), water solutions of water-soluble polymers such as PVP or PVA, or mixtures of water and alcohols, such as ethanol, propanol or isopropanol.

The non-solvent is most preferably water.

The temperature of the water bath is preferably between 2° and 90° C., more preferably between 4° and 70° C.

The transfer of solvent from the coated polymer layer towards the non-solvent bath and of non-solvent into the polymer layer leads to phase inversion and the formation of a three-dimensional porous polymer network. The impregnation of the applied dope solution into the support results in a sufficient adhesion between the obtained hydrophilic layers onto the support.

In a preferred embodiment, the continuous web (100) coated on one or either side with a dope solution is transported downwards, in a vertical position, towards the coagulation bath (800) as shown in FIGS. 3 and 4.

In a VIPS step, the support coated with the dope solutions is exposed to non-solvent vapour, preferably humid air.

Preferably, the coagulation step included both a VIPS and a LIPS step. Preferably, the support coated with the dope solutions is first exposed to humid air (VIPS step) prior to immersion in the coagulation bath (LIPS step).

In the manufacturing method shown in FIG. 3, VIPS is carried out in the area 400, between the slot coating dies (200, 300) and the surface of the non-solvent in the coagulation bath (800), which is shielded from the environment with for example thermal isolated metal plates (500).

The extent and rate of water transfer in the VIPS step can be controlled by adjusting the velocity of the air, the relative humidity and temperature of the air, as well as the exposure time.

The exposure time may be adjusted by changing the distance d between the slot coating dies (200, 300) and the surface of the non-solvent in the coagulation bath (800) and/or the speed with which the elongated web 100 is transported from the slot coating dies towards the coagulation bath.

The relative humidity in the VIPS area (400) may be adjusted by the temperature of the coagulation bath and the shielding of the VIPS area (400) from the environment and from the coagulation bath.

The speed of the air may be adjusted by the rotating speed of the ventilators (420) in the VIPS area (400).

The VIPS step carried out on one side of the separator and on the other side of the separator, resulting in the second porous polymer layer, may be identical (FIG. 3) or different (FIG. 4) from each other.

After the phase inversion step, preferably the LIPS step in the coagulation bath, a washing step may be carried out.

After the phase inversion step, or the optional washing step, a drying step is preferably carried out.

Removal Temporary Support

The temporary support may be removed before or after placing the separator between the electrodes of an electrolyser.

When the temporary support is removed before placing the separator into an alkaline electrolyser, dissolved material from the porous support or degradation products of the porous support after removal of the support by the electrolyte of an alkaline electrolyser will not adversely affect the electro-catalytic properties of the electrodes, or the electrolytic process. However, when the support is removed outside the electrolyser the advantage of extra reinforcement to manipulate or handle the separator sheets when assembling the electrolyser stack will not be present.

The reinforced separator including the porous support is preferably subjected to an alkaline solution after the phase inversion step.

Preferably, the separator including the porous support is entered into a bath comprising the alkaline solution.

After the alkaline treatment wherein the support is removed, the resulting separator is preferably subjected to a washing step optionally followed by a drying step.

The alkaline solution is preferably a 20-40 wt % aqueous KOH solution, more preferably a 30 wt % aqueous KOH solution.

The temperature of the alkaline solution is preferably at least 50° C.

Manufacturing of the Separator

FIGS. 3 and 4 schematically illustrates a preferred embodiment to manufacture a separator according to the present invention.

The porous support is preferably a continuous web (100).

The web is unwinded from a feed roller (600) and guided downwards in a vertical position between two coating units (200) and (300).

With these coating units, a dope solution is coated on either side of the web. The coating thickness on either side of the web may be adjusted by optimizing the viscosity of the dope solutions and the distance between the coating units and the surface of the web. Preferred coating units are described in EP-A 2296825, paragraphs [0043], [0047], [0048], [0060], [0063], and FIG. 1.

The web coated on both sides with a dope solution is then transported over a distance d downwards towards a coagulation bath (800).

In the coagulation bath, the LIPS step is carried out.

The VIPS step is carried out before entering the coagulation bath in the VIPS areas. In FIG. 3, the VIPS area (400) is identical on both sides of the coated web, while in FIG. 4, the VIPS areas (400(1)) and (400(2)) on either side of the coated web are different.

The relative humidity (RH) and the air temperature in de VIPS area may be optimized using thermally isolated metal plates. In FIG. 3, the VIPS area (400) is completely shielded from the environment with such metal plates (500). The RH and temperature of the air is then mainly determined by the temperature of the coagulation bath. The air speed in the VIPS area may be adjusted by a ventilator (420).

In FIG. 4 the VIPS areas (400(1)) and (400(2)) are different from each other. The VIPS area (400(1)) on one side of the coated web including a metal plate (500(1)) is identical to the VIPS area (400) in FIG. 2. The VIPS area (400(2)) on the other side of the coated web is different from the area (400(1)). There is no metal plate shielding the VIPS area (400(2)) from the environment. However, the VIPS area (400(2)) is now shielded from the coagulation bath by a thermally isolated metal plate (500(2)). In addition, there is no ventilator present in the VIPS area 400(2). This results in a VIPS area (400(1)) having a higher RH and air temperature compared to the RH and air temperature of the other VIPS area (400(2)).

A high RH and/or a high air speed in a VIPS area typically result in a larger maximum pore diameter.

The RH in one VIPS area is preferably above 85%, more preferably above 90%, most preferably above 95% while the RH in another VIPS area is preferably below 80%, more preferably below 75%, most preferably below 70%.

After the phase separation step, the reinforced separator is then transported to a rolled up system (700).

A liner may be provided on one side of the separator before rolling up the separator and the applied liner.

Electrolyser

The separator for alkaline water electrolysis according to the present invention may be a used in an alkaline water electrolyser.

An electrolysis cell typically consists of two electrodes, an anode and a cathode, separated by a separator. An electrolyte is present between both electrodes.

When electrical energy (voltage) is supplied to the electrolysis cell, hydroxyl ions of the electrolyte are oxidized into oxygen at the anode and water is reduced to hydrogen at the cathode. The hydroxyl ions formed at the cathode migrate through the separator to the anode. The separator prevents mixing of the hydrogen and oxygen gases formed during electrolysis.

An electrolyte solution is typically an alkaline solution. Preferred electrolyte solutions are aqueous solutions of electrolytes selected from sodium hydroxide or potassium hydroxide. Potassium hydroxide electrolytes are often preferred due to their higher specific conductivity. The concentration of the electrolyte in the electrolyte solution is preferably from 10 to 40 wt %, more preferably from 20 to 35 wt %, relative to the total weight of the electrolyte solution. A highly preferred electrolyte is a 30 wt % aqueous KOH solution. The temperature of the electrolyte solution is preferably from 50° C. to 120° C., more preferably from 80° C. to 100° C.

An electrode typically include a substrate provided with a so-called catalyst layer. The catalyst layer may be different for the anode, where oxygen is formed, and the cathode, where hydrogen is formed.

Typical substrates are made from electrically conductive materials selected from the group consisting of nickel, iron, soft steels, stainless steels, vanadium, molybdenum, copper, silver, manganese, platinum group elements, graphite, and chromium. The substrates may be made from an electrically conductive alloy of two or more metals or a mixture of two or more electrically conductive materials. A preferred material is nickel or nickel-based alloys. Nickel has a good stability in strong alkaline solutions, has a good conductivity and is relatively cheap.

The catalyst layer provided on the anode preferably has a high oxygen-generating ability. The catalyst layer preferably includes nickel, cobalt, iron, and platinum group elements. The catalyst layer may include these elements as elemental metals, compounds (e.g., oxides), composite oxides or alloys made of multiple metal elements, or mixtures thereof. Preferred catalyst layers include plated nickel, plated alloys of nickel and cobalt or nickel and iron, complex oxides including nickel and cobalt such as $LaNiO_3$, $LaCoO_3$, and $NiCo_2O_4$, compounds of platinum group elements such as iridium oxide, or carbon materials such as graphene.

The Raney nickel structure is formed by selectively leaching aluminium or zinc from a Ni—Al or Ni—Zn alloy. Lattice vacancies formed during leaching result in a large surface area and a high density of lattice defects, which are active sites for the electrocatalytic reaction to take place.

The catalyst layer may also include organic substances such as polymers to improve the durability and the adhesion towards the substrate.

The catalyst layer provided on the cathode preferably has a high hydrogen-generating ability. The catalyst layer preferably includes nickel, cobalt, iron, and platinum group elements. To realize the desired activity and durability, the catalyst layer may include a metal, a compound such as an oxide, a complex oxide or alloy composed of a plurality of metal elements, or a mixture thereof. A preferred catalyst layer is formed from Raney Nickel; Raney alloys made of combinations of multiple materials (e.g. nickel and aluminium, nickel and tin); porous coatings made by spraying nickel compounds or cobalt compounds by plasma thermal spraying; alloys and composite compounds of nickel and an element selected from cobalt, iron, molybdenum, silver, and copper, for example; elementary metals and oxides of platinum group elements with high hydrogen generation abilities (e.g. platinum and ruthenium); mixtures of elementary metals or oxides of those platinum group element metals and compounds of another platinum group element (e.g. iridium or palladium) or compounds of rare earth metals (e.g. lanthanum and cerium); and carbon materials (e.g. graphene).

For providing higher catalyst activity and durability, the above described materials may be laminated in a plurality of layers, or may be contained in the catalyst layer.

An organic material, such as a polymer material, may be contained for improved durability or adhesiveness to the substrate.

In a so-called zero gap electrolytic cell the electrodes are placed directly in contact with the separator thereby reducing the space between both electrodes. Mesh-type or porous electrodes are used to enable the separator to be filled with electrolyte and for efficient removal of the oxygen and hydrogen gasses formed. It has been observed such zero gap electrolytic cells operate at higher current densities.

A typical alkaline water electrolyser include several electrolytic cells, also referred to stack of electrolytic cells, described above.

Figure 5:
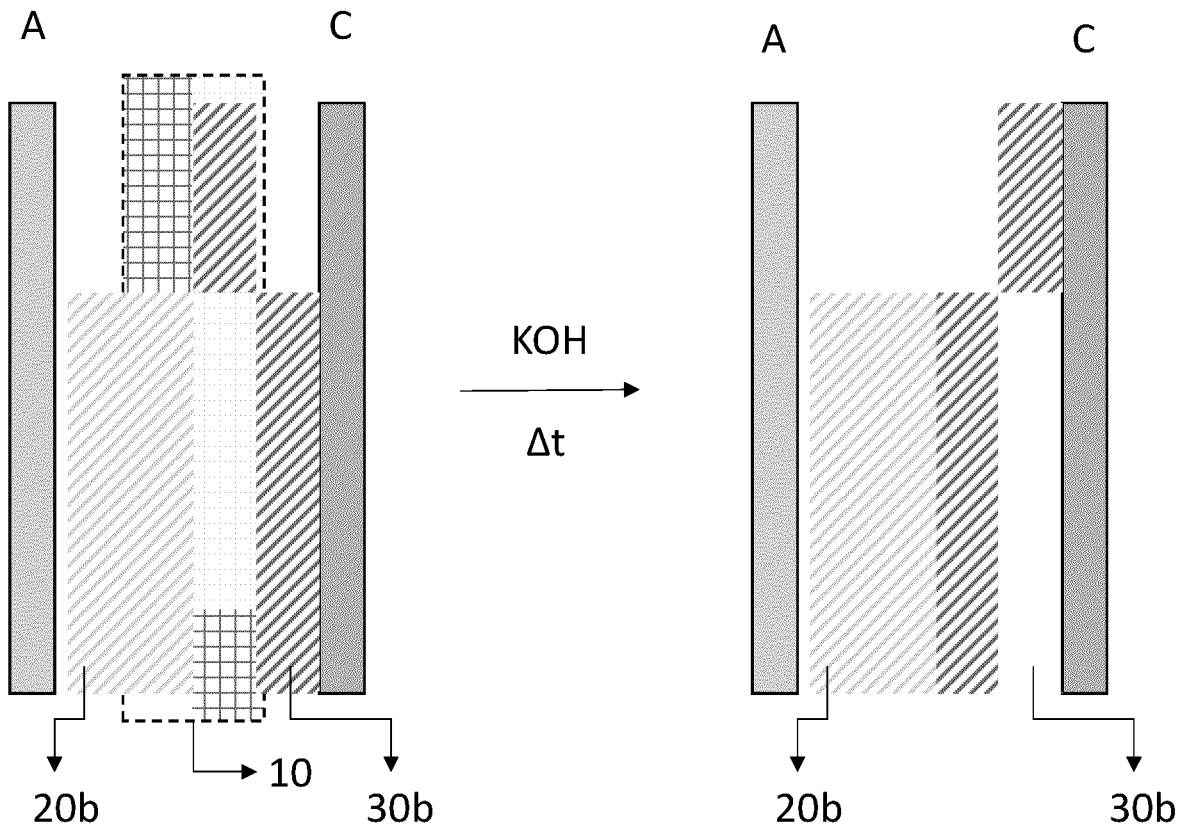
FIG. 5 shows a schematic representation of a membrane electrode assembly for an alkaline electrolyser.

In FIG. 5, a schematic representation is shown of a zero gap membrane electrode assembly according to the present invention. Such a membrane electrode assembly includes a separator (membrane) interposed between two electrodes. After placing the membrane electrode assembly, including the separator assembly between an anode (A) and a cathode (C), in an alkaline electrolyser (FIG. 5, left part), the temporary support will be substantially removed by the electrolyte resulting in the operational membrane electrode assembly (FIG. 5, right part).

The invention claimed is:

1. A porous separator for alkaline water electrolysis comprising a porous support and a porous layer provided on the porous support, characterized in that the porous support is capable of being substantially removed from the porous separator, and the porous separator has a maximum pore diameter (PDmax) between 0.05 and 2 μm.

2. The porous separator of claim 1, wherein the porous support is capable of being substantially removed by an electrolyte of an alkaline electrolyser.

3. The porous separator of claim 2, wherein the porous support is capable of being substantially removed by the electrolyte after 24 to 48 hours.

4. The porous separator of claim 1, wherein the thickness of the porous support is from 20 μm to 400 μm.

5. The porous separator of claim 1, wherein the thickness of the porous separator is from 50 μm to 500 μm.

6. The porous separator of claim 1, wherein the porous support comprises polyester, polyamide, polyolefin, or cellulose.

7. The porous separator of claim 1, wherein a first and second porous layer is provided on respectively one side and the other side of the porous support.

8. The porous separator of claim 7, wherein the first and second porous layer includes a polymer resin and hydrophilic inorganic particles.

9. The porous separator of claim 8, wherein the polymer resin is at least one selected from the group consisting of polysulfone, polyethersulfone, and polyphenylsulfide.

10. The porous separator of claim 8, wherein the hydrophilic inorganic particles comprise at least one material selected from the group consisting of zirconium oxide, zirconium hydroxide, magnesium oxide, magnesium hydroxide, titanium oxide, titanium hydroxide, and barium sulfate.

11. The porous separator of claim 7, wherein the first and the second porous layer are the same.

12. The porous separator of claim 8, wherein the first and the second porous layer are the same.

13. The porous separator of claim 9, wherein the first and the second porous layer are the same.

14. The porous separator of claim 10, wherein the first and the second porous layer are the same.

15. A method of manufacturing a porous separator for alkaline water electrolysis as defined in claim 1, the method comprising:

applying a dope solution including a polymer resin, hydrophilic inorganic particles, and a solvent on a porous support, and performing phase inversion on the applied dope solution thereby forming a porous layer on the porous support.

16. The method of claim 15, further comprising the step of substantially removing the porous support from the porous separator in an alkaline solution.

17. The method of claim 16, wherein the alkaline solution is a 10 wt. % to 40 wt. % aqueous KOH solution at a temperature of 50° C. or higher.

18. An alkaline water electrolyser comprising a porous separator as defined in claim 1 located between a cathode and an anode.

19. The porous separator of claim 1, wherein the maximum pore diameter (PDmax) of the porous separator is between 0.10 and 1 μm.

20. The porous separator of claim 1, wherein the maximum pore diameter (PDmax) of the porous separator is between 0.15 and 0.5 μm.

* * * * *